US012759105B2

(12) United States Patent
Lopez et al.

(10) Patent No.: US 12,759,105 B2
(45) Date of Patent: Oct. 13, 2026

(54) FLOOR POLISHING ARMATURE

(71) Applicants: Javier Lopez, Yorba Linda, CA (US); Sergio Gamez, Yorba Linda, CA (US)

(72) Inventors: Javier Lopez, Yorba Linda, CA (US); Sergio Gamez, Yorba Linda, CA (US)

( * ) Notice: Subject to any disclaimer, the term of this patent is extended or adjusted under 35 U.S.C. 154(b) by 406 days.

(21) Appl. No.: 17/894,951

(22) Filed: Aug. 24, 2022

(65) Prior Publication Data

US 2024/0051077 A1 Feb. 15, 2024

Related U.S. Application Data

(63) Continuation-in-part of application No. 29/849,393, filed on Aug. 10, 2022, now Pat. No. Des. 1,069,282.

(51) Int. Cl.

| | |
|---|---|
| ***B24B 7/18*** | (2006.01) |
| ***B24D 7/10*** | (2006.01) |
| ***B24D 9/08*** | (2006.01) |

(52) U.S. Cl.

CPC ..... *B24B 7/186* (2013.01); *B24B 7/18* (2013.01); *B24D 7/10* (2013.01); *B24D 9/08* (2013.01)

(58) Field of Classification Search

CPC ..... B24B 7/186; B24B 7/18; B24B 7/188; B24B 41/047; A47L 11/162; A47L 11/4038; B24D 9/08; B24D 7/10; B24D 7/06; B24D 7/066; B24D 7/18

USPC ..... 451/353, 548, 550

See application file for complete search history.

(56) References Cited

U.S. PATENT DOCUMENTS

| | | | | |
|---|---|---|---|---|
| 5,421,053 | A * | 6/1995 | Chodak | A47L 11/4069 15/49.1 |
| 2008/0009232 | A1* | 1/2008 | Thysell | B24B 7/186 451/548 |
| 2010/0175237 | A1* | 7/2010 | Luk-Tung | B24D 7/16 451/442 |
| 2011/0287700 | A1* | 11/2011 | Gamba | B24D 7/066 451/340 |
| 2012/0270483 | A1* | 10/2012 | Bae | B24D 7/066 451/540 |

(Continued)

FOREIGN PATENT DOCUMENTS

| | | | |
|---|---|---|---|
| EP | 3231321 | A1 * | 10/2017 |
| EP | 3542961 | A1 * | 9/2019 |

OTHER PUBLICATIONS

NPL1, Definition of Spoke, Merriam Webster, Available Jan. 18, 2019; https://www.merriam-webster.com/dictionary/spoke (Year: 2019).*

*Primary Examiner* — Michael A Gump
(74) *Attorney, Agent, or Firm* — Clement Cheng

(57) ABSTRACT

A floor polishing armature including an inner ring having an inner ring upper surface and an inner ring lower surface, an outer ring, spokes extending between the inner ring and the outer ring, a disc retainer formed on the outer ring, a spoke opening extending from the inner ring upper surface to the inner ring lower surface, and a disc insert retained in the disc retainer. The disc is insert adapted for floor treatment. The spoke opening extends to the disc retainer. The disc insert is released by pressing through the spoke opening. Optionally, airflow openings are formed between the spokes. Spoke indents are preferably formed on an underside of the spokes between the inner ring and the disc retainer. The disc inserts and the arc inserts are both retained by interference fit.

15 Claims, 8 Drawing Sheets

(56) References Cited

U.S. PATENT DOCUMENTS

2018/0304442 A1* 10/2018 Cichy ..... B24D 5/16
2018/0369981 A1* 12/2018 Craft ..... B24B 47/12

* cited by examiner

FLOOR POLISHING ARMATURE

FIELD OF THE INVENTION

The present invention is in the field of floor polishing armatures.

DISCUSSION OF RELATED ART

A variety of different floor polishing armatures are used for polishing concrete floors. Manufacturing or maintaining finished concrete floors requires a variety of different steps including sanding, scrubbing, brushing, mopping and buffing.

SUMMARY OF THE INVENTION

A floor polishing armature including an inner ring having an inner ring upper surface and an inner ring lower surface, an outer ring, spokes extending between the inner ring and the outer ring, a disc retainer formed on the outer ring, a spoke opening extending from the inner ring upper surface to the inner ring lower surface, and a disc insert retained in the disc retainer. The disc is insert adapted for floor treatment. The spoke opening extends to the disc retainer. The disc insert is released by pressing through the spoke opening.

Optionally, airflow openings are formed between the spokes. Spoke indents are preferably formed on an underside of the spokes between the inner ring and the disc retainer. The floor portion armature may have a first disc retainer, a second disc retainer, a third disc retainer, and a fourth disc retainer set at 90 degrees from each other. The disc retainer preferably has disc protrusion retainers extending horizontally from disc retainer sidewalls.

The disc protrusion retainers include a distal disc protrusion retainer, and a proximal disc protrusion retainer. The proximal disc protrusion retainer is opposite the distal disc protrusion retainer. The disc protrusion retainers also include a first lateral disc protrusion retainer and a second lateral disc protrusion retainer. The second lateral disc protrusion retainer is opposite the first lateral disc protrusion retainer. An arc opening is formed on the outer ring. The arc opening extends to an arc retainer to allow an arc insert to be injected by pressing through the arc opening. The retainer also has a proximal arc protrusion retainer opposing a pair of distal arc protrusion retainers. The disc inserts and the arc inserts are both retained by interference fit.

Figure 1:
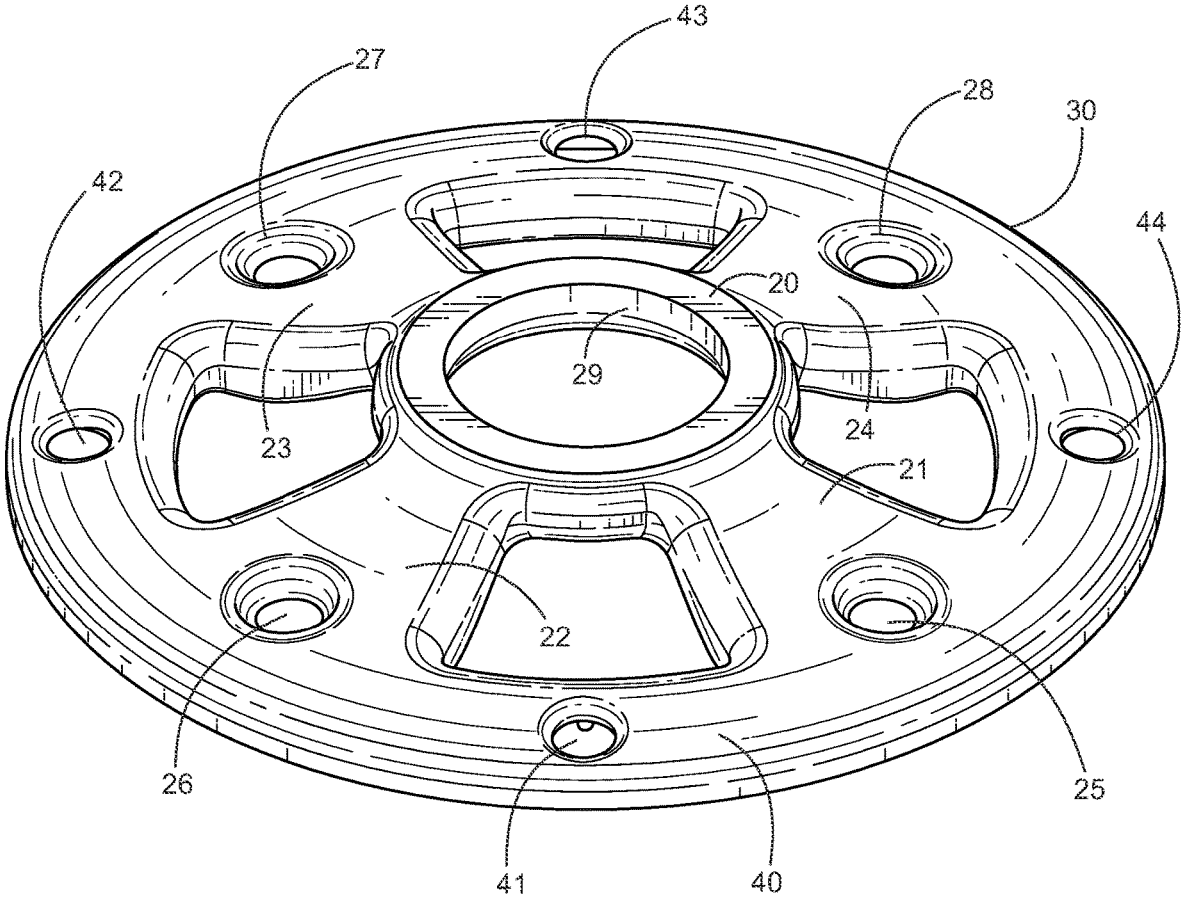
FIG. 1 is a top perspective view of the present invention.

The following callout list of elements can be a useful guide in referencing the element numbers of the drawings.

20 inside ring
21 first spoke

22 second spoke
23 third spoke
24 fourth spoke
25 first spoke opening
26 second spoke opening
27 third spoke opening
28 fourth spoke opening
29 inside ring inside step
30 outside ring
31 first disc retainer
32 second disc retainer
33 third disc retainer
34 fourth disc retainer
35 first air intake opening
36 second air intake opening
37 third air intake opening
38 fourth air intake opening
39 spoke indent
40 arc position
41 first arc opening
42 second arc opening
43 third arc opening
44 fourth arc opening
45 first arc retainer
46 second arc retainer
47 third arc retainer
48 fourth arc retainer
49 arc portion outside sidewall
51 distal disc protrusion retainer
52 proximal disc protrusion retainer
53 first lateral disc protrusion retainer
54 second lateral disc protrusion retainer
55 proximal disc sidewall
56 distal disc sidewall
57 first arc disc sidewall
58 second arc disc sidewall
60 arc protrusion retainer
61 proximal arc protrusion retainer
62 distal arc protrusion retainer
63 proximal arc retainer sidewall
64 distal arc retainer sidewall
71 inside ring upper surface
72 inside ring interior surface
73 sloped opening profile
74 disc retainer hollow
75 driving shaft protrusion
76 driving shaft step
80 inserts
81 first disc insert
82 second disc insert
83 third disc insert
84 fourth disc insert
85 first arc insert
86 second arc insert
87 third arc insert
88 fourth arc insert
89 insert engagement area

DETAILED DISCUSSION OF THE PREFERRED EMBODIMENT

As seen in FIG. 1, the present invention is a floor polishing armature having an inside ring 20 and an outside ring 30 connected by spokes including a first spoke 21, a second spoke 22, a third spoke 23, and a fourth spoke 24. Spoke openings are formed on the spokes and formed between the inside ring and outside ring. The outside ring forms a hub. Spoke openings including a first spoke opening 25 formed on the first spoke 21, a second spoke opening 26 formed on the second spoke 22, a third spoke opening 27 formed on the third spoke 23, and a fourth spoke opening 28 formed on the fourth spoke 24.

The inside ring connects to a floor polishing machine. Optionally, the inside ring 20 has an inside ring inside step 29. The hub portion of the wheel shaped floor polishing armature is preferably formed as an arc portion 40 having an arc portion profile. The arc portion sections have arc openings including a first arc opening 41 formed between the first spoke 21 and the second spoke 22, a second arc opening 42 formed between the second spoke 22 and the third spoke 23, a third arc opening 43 formed between the third spoke 23 and the fourth spoke 24, and a fourth arc opening 44 formed between the fourth spoke 24 and the first spoke 21.

Figure 2:
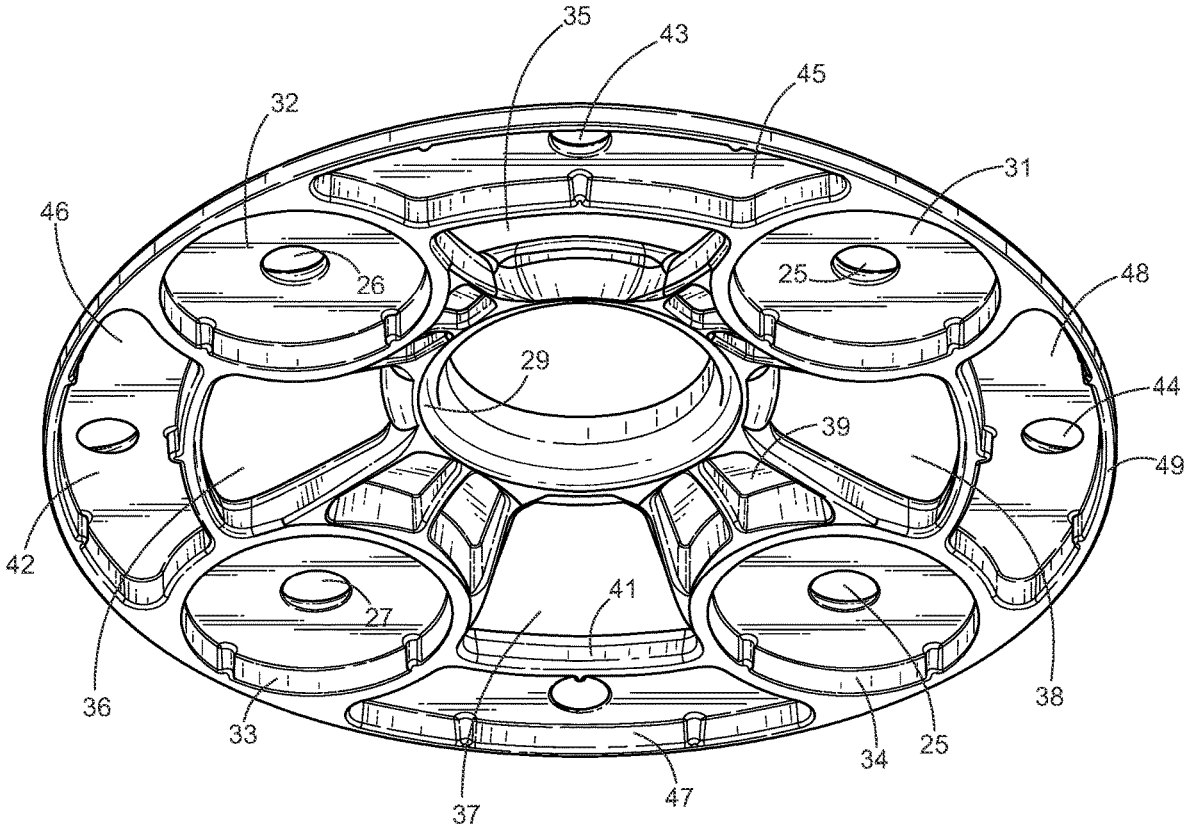
FIG. 2 is a bottom perspective view of the present invention.
Figure 3:
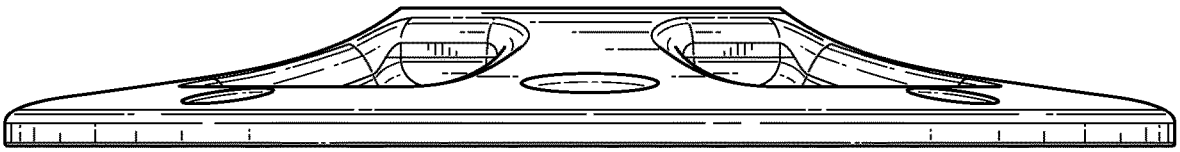
FIG. 3 is a front view of the present invention.
Figure 4:
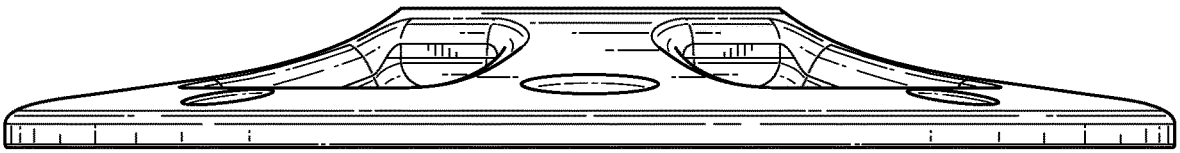
FIG. 4 is a rear view of the present invention.
Figure 5:
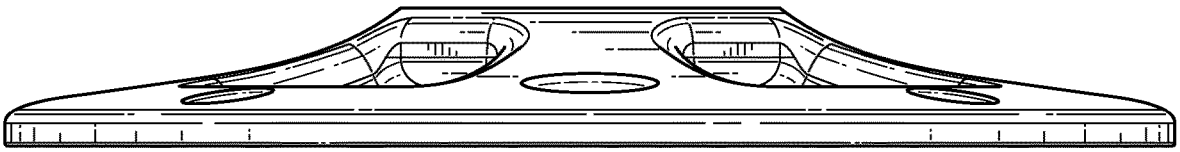
FIG. 5 is a left view of the present invention.
Figure 6:
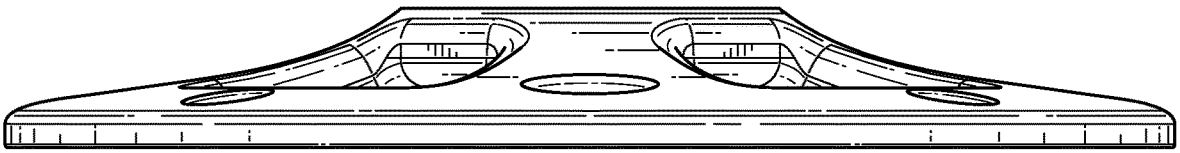
FIG. 6 is a right view of the present invention.

As seen in FIG. 2, the first spoke opening 25 extends through a first disc retainer 31, the second spoke opening 26 extends through a second disc retainer 32, the third spoke opening 27 extends through a third disc retainer 33, and the fourth spoke opening 28 extends through a fourth disc retainer 34. The spoke openings are large enough for manual digit extension through the spoke openings allowing a user to reach an article through the spoke opening. The inside ring inside step 29 can be a gradual step profile.

The first air intake opening 35 is formed between the first spoke in the second spoke, the second air intake opening 36 is formed between the second spoke and the third spoke, the third air intake opening 37 is formed between the third spoke and the fourth spoke, and the fourth air intake opening 38 is formed between the fourth spoke and the first spoke. Preferably, a spoke indent 39 is formed on an underside of each spoke.

The first arc opening 41 extends into a first arc retainer 45. The second arc opening 42 extends into a second arc retainer 46. The third arc opening 43 extends into a third arc retainer 47. The fourth arc opening 44 extends into a fourth arc retainer 48. The arc portion has an arc portion outside sidewall 49 that can be flexible or rigid to assist in receiving an arc-shaped floor polishing pad.

Figure 7:
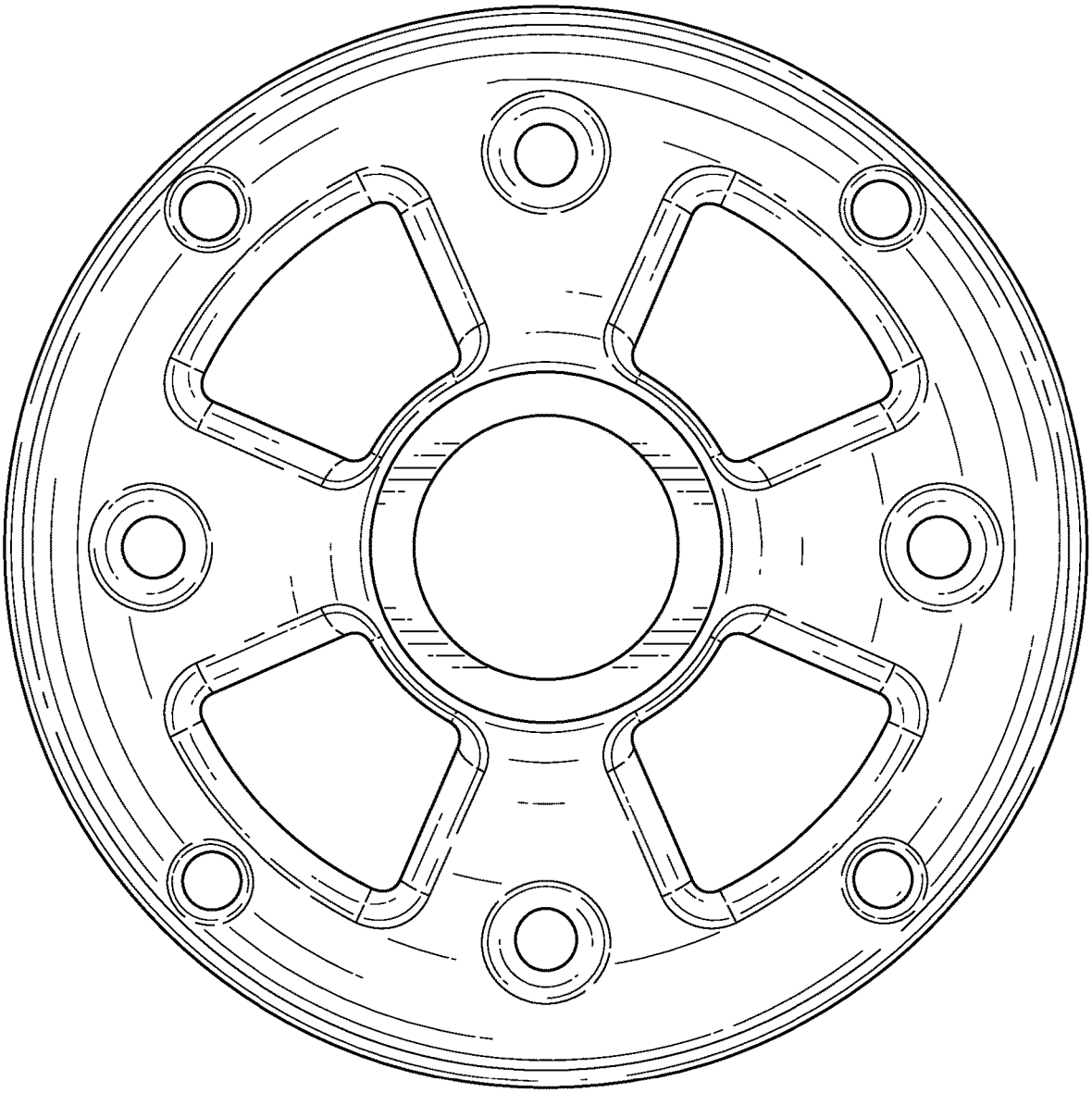
FIG. 7 is a top view of the present invention.

As seen in FIGS. 3-6, the side views and the front and rear views are congruent such that the floor polishing armature has multiple sided symmetry, such as the four sided symmetry seen in FIG. 7.

Figure 8:
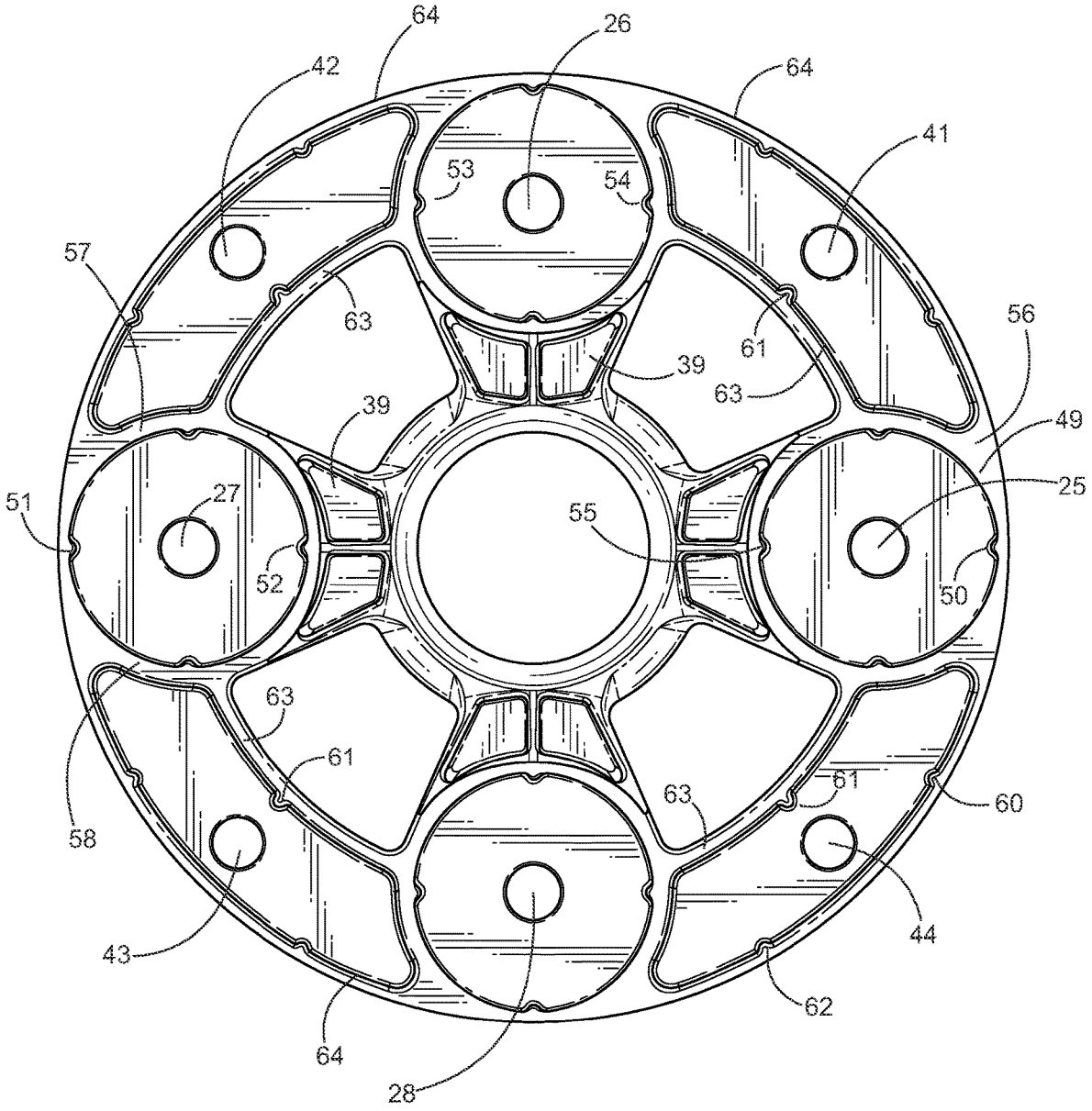
FIG. 8 is a bottom view of the present invention.

As seen in FIG. 8, the spoke openings extend through to the disc retainers. The disc retainers are formed as round hollows having disc protrusion retainers 50 which include a distal disc protrusion retainer 51 opposite a proximal disc protrusion retainer 52, and a first lateral disc protrusion retainer 53 opposite a second lateral disc protrusion retainer 54.

The first spoke opening 25, the second spoke opening 26, the third spoke opening 27, and the fourth spoke opening 28 all have their respective disc protrusion retainers. The spoke openings are between the distal disc protrusion retainer 51 and the proximal disc protrusion retainer 52. The spoke openings are also between the first lateral disc protrusion retainer 53 and the second lateral disc protrusion retainer 54.

Adjacent to the spoke indent 39, the proximal disc sidewall 55 has a proximal disc protrusion retainer 52. The distal disc protrusion retainer 51 is formed on the distal disc sidewall 56 portion of the arc portion outside sidewall 49. The first lateral disc protrusion retainer 53 is formed on the first arc disc sidewall 57. The second lateral disc protrusion retainer 54 is formed on the second arc disc sidewall 58.

The first arc opening 41 passes through to the first arc retainer 45. The first arc retainer 45 has arc protrusion retainers 60. The arc protrusion retainers 60 include a proximal arc protrusion retainer 61 formed on the proximal arc retainer sidewall 63 and a distal arc protrusion retainer 62 formed on the distal arc retainer sidewall 64.

The second arc opening 42, the third arc opening 43, and the fourth arc opening 44 have a similar configuration is the first arc opening 41. Although arc openings extend downwardly into the arc retainer hollows. The arc retainers are bounded by an arc portion outside sidewall 49 having a distal arc retainer sidewall 64 from which protrude of distal art protrusion retainers 62. The proximal arc protrusion retainer 61 is opposite the pair of distal arc protrusion retainers 62.

Figure 9:
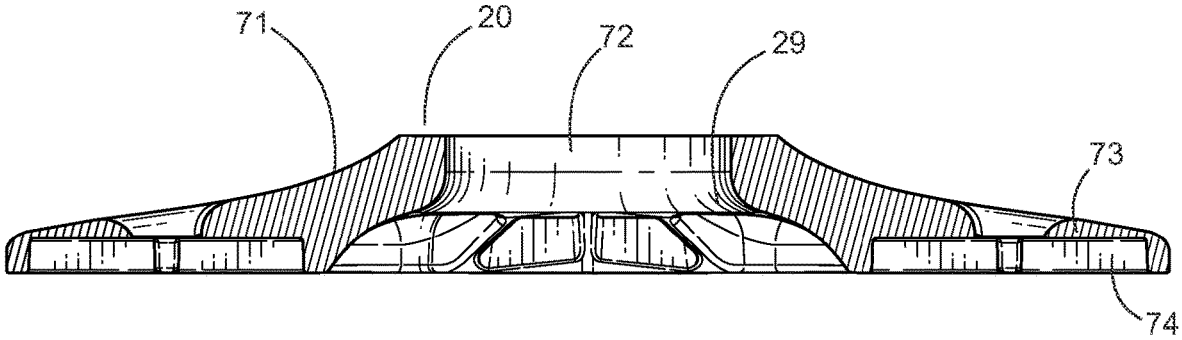
FIG. 9 is a cross-section view of the present invention.

As seen in FIG. 9, the inside ring upper surface 71 of the inside ring 20 can engage a floor polishing machine. Additionally, the inside ring has an inside ring interior surface 72 that also can engage a floor polishing machine. The access openings such as the arc openings and the disc openings preferably have a sloped opening profile 73 for tactile identification. The disc retainer is formed as a disc retainer hollow 74.

Figure 10:
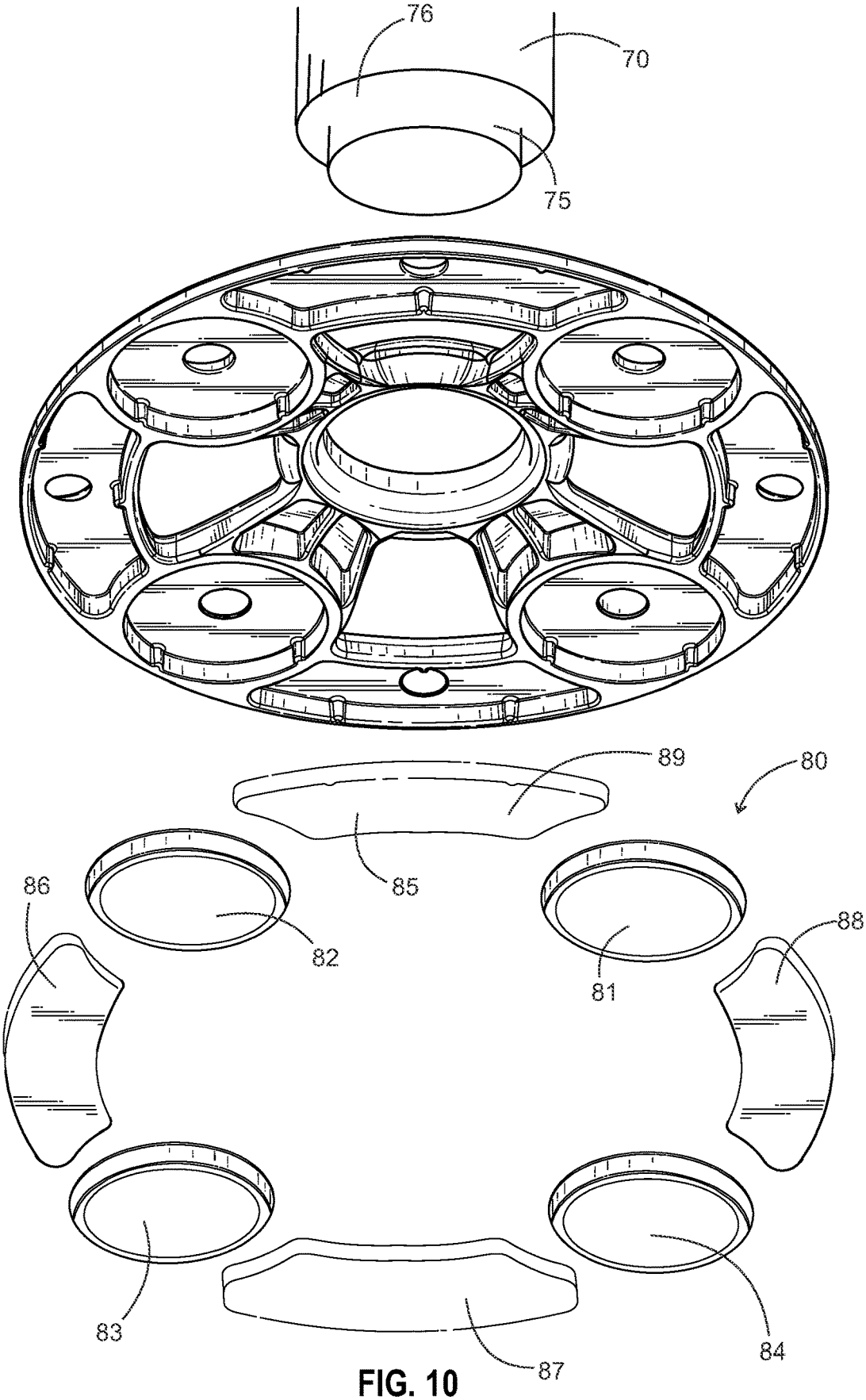
FIG. 10 is a bottom perspective exploded view of the present invention.

As seen in FIG. 10, a driving shaft 70 can have a driving shaft protrusion 75 and optionally a driving shaft step 76. The floor polishing armature is preferably interference fit with the driving shaft 70 such that can be readily removed with downward pressure. The downward pressure required for removing an armature is less than the downward pressure required for removing an insert. Downward pressure required can be calibrated by tightness of dimensions of interference fit.

The inserts 80 can be for sanding, scraping, scrubbing, buffing, polishing or any other floor construction or preparation process. The first disc insert 81, the second disc insert 82, the third disc insert 83, and the fourth disc insert 84 connect to the disc retainer hollows 74 of the disc retainers. Similarly, the arc inserts including the first arc insert 85, the second arc insert 86, the third arc insert 87, and the fourth arc insert 88 connect to the arc retainer hollows of the arc retainers. The inserts 80 have a lower surface which is the insert engagement area 89 which applies a floor treatment to a floor below it.

The inserts can be popped out and interchanged without removing the floor polishing armature from the driving shaft 70. If a floor conditioning process requires a first step with a first type of insert, a second step with a second type of insert, and a third step with a third type of insert, then the present invention allows hot swapping of inserts without removing the armature. A user can raise the floor polishing armature on the floor polishing machine, then pop out each insert as required. The inserts can also be mixed such that the disc inserts process a first floor treatment step while the arc inserts process a second for treatment step. The airflow through the airflow openings and the thinwall construction of the floor polishing armature having many lower hollows provides thermal dissipation while retaining rigidity and presenting a smooth upper surface.

The invention claimed is:

1. A floor polishing armature comprising:

(a) an inner ring having an inner ring upper surface and an inner ring lower surface;

(b) an outer ring;

(c) spokes extending between the inner ring and the outer ring, wherein the spokes have a width narrower than a space between the spokes;

(d) a disc retainer formed on the outer ring, wherein the disc retainer has disc retainer horizontally protruding retainers;

(e) a spoke opening extending from the inner ring upper surface to the inner ring lower surface, wherein the spoke opening extends to the disc retainer; and (f) a disc insert retained in the disc retainer, wherein the disc insert is adapted for floor treatment, wherein the disc insert is released by pressing through the spoke opening, wherein the disc insert does not protrude through the spoke opening, wherein the disc retainer horizontally protruding retainers retains the disc insert.

2. The floor polishing armature of claim 1, further including: an airflow openings formed between the spokes, respectively.

3. The floor polishing armature of claim 1, further including: a spoke indent formed on an underside of each of the spokes, respectively, between the inner ring and the disc retainer, wherein the inner ring and outer ring are not a flat plate.

4. The floor polishing armature of claim 1, wherein the disc retainer is a first disc retainer, and further including: a second disc retainer, a third disc retainer, and a fourth disc retainer.

5. The floor polishing armature of claim 1, wherein the disc retainer further includes the disc retainer horizontally protruding retainers extending horizontally from a disc retainer sidewalls.

6. The floor polishing armature of claim 1, wherein the disc retainer further includes the disc retainer horizontally protruding retainers including including a distal disc protrusion retainer, and a proximal disc protrusion retainer, wherein the proximal disc protrusion retainer is opposite the distal disc protrusion retainer, wherein the disc protrusion retainers also include a first lateral disc protrusion retainer and a second lateral disc protrusion retainer, wherein the second lateral disc protrusion retainer is opposite the first lateral disc protrusion retainer.

7. The floor polishing armature of claim 1, further including: an arc opening formed on the outer ring, wherein the arc opening extends to an arc retainer; an arc insert, wherein the arc insert is retained in the arc retainer and released by pressing through the arc opening, wherein the arc insert is mounted inline with the disc insert.

8. The floor polishing armature of claim 7, further including: an airflow opening formed between the spokes, respectively.

9. The floor polishing armature of claim 7, further including: a spoke indent formed on an underside of each of the spokes, respectively, between the inner ring and the disc retainer.

10. The floor polishing armature of claim 7, wherein the disc retainer is a first disc retainer, and further including: a second disc retainer, a third disc retainer, and a fourth disc retainer.

11. The floor polishing armature of claim 7, wherein the disc retainer further includes the disc retainer horizontally protruding retainers extending horizontally from a disc retainer sidewall.

12. The floor polishing armature of claim 7, wherein the disc retainer further includes the disc retainer horizontally protruding retainers including a distal disc protrusion retainer, and a proximal disc protrusion retainer, wherein the proximal disc protrusion retainer is opposite the distal disc protrusion retainer, wherein the disc protrusion retainers also include a first lateral disc protrusion retainer and a second lateral disc protrusion retainer, wherein the second lateral disc protrusion retainer is opposite the first lateral disc protrusion retainer.

13. The floor polishing armature of claim 7, wherein the arc retainer further includes a proximal arc protrusion retainer opposing a pair of distal arc protrusion retainers, wherein the arc retainer secures the arc insert through is an interference fit, wherein the proximal arc protrusion retainer and the pair of distal arc protrusion retainers are formed as horizontally protruding arc retainers.

14. The floor polishing armature of claim 7, wherein the disc inserts and the arc insert are both retained by interference fit.

15. The floor polishing armature of claim 7, wherein the inner ring is adapted to connect to a floor polishing machine driveshaft.

* * * * *